US006592330B2

(12) United States Patent
Leeke et al.

(10) Patent No.: US 6,592,330 B2
(45) Date of Patent: Jul. 15, 2003

(54) METHOD AND APPARATUS FOR NON-PARALLEL TURBINE DOVETAIL-FACES

(75) Inventors: Leslie Eugene Leeke, Burlington, KY (US); Sean Robert Keith, Fairfield, OH (US); Ronald Eugene Mc Rae, Jr., Wyoming, OH (US); Robert Ingram Ackerman, West Chester, OH (US); Richard William Albrecht, Jr., Fairfield, OH (US)

(73) Assignee: General Electric Company, Schenectady, NY (US)

( * ) Notice: Subject to any disclaimer, the term of this patent is extended or adjusted under 35 U.S.C. 154(b) by 94 days.

(21) Appl. No.: 09/943,528

(22) Filed: Aug. 30, 2001

(65) Prior Publication Data

US 2003/0044284 A1 Mar. 6, 2003

(51) Int. Cl.[7] ..... F03B 3/14
(52) U.S. Cl. ..... 416/219 R; 29/889.21
(58) Field of Search ..... 416/219 R; 29/889.21

(56) References Cited

U.S. PATENT DOCUMENTS 3,045,968 A * 7/1962 Willis ..... 416/219 R
4,191,509 A * 3/1980 Leonardi ..... 416/219 R
4,692,976 A * 9/1987 Andrews ..... 29/557
4,824,328 A * 4/1989 Pisz et al. ..... 416/219 R
5,183,389 A 2/1993 Gilchrist et al.
5,310,317 A 5/1994 Bailey et al.
5,494,408 A 2/1996 Seeley et al.
5,511,945 A * 4/1996 Glezer et al. ..... 416/219 R
5,622,475 A 4/1997 Hayner et al.

* cited by examiner

*Primary Examiner*—Edward K. Look
*Assistant Examiner*—Dwayne J. White
(74) *Attorney, Agent, or Firm*—Rodney M. Young; Armstrong Teasdale LLP

(57) ABSTRACT

A dovetail assembly including non-parallel relief faces that facilitates reduced pressure face brinelling in turbine engines. The assembly includes a plurality of rotor blades, each including a dovetail. Each dovetail includes at least a pair of blade tangs including blade relief faces. The dovetail assembly also includes a rotor disk including a plurality of dovetail slots, each sized to receive a dovetail. Each dovetail slot is defined by at least one pair of opposing disk tangs including disk relief faces. The disk relief faces are non-parallel to the blade relief faces when the dovetail is mounted in the dovetail slot.

17 Claims, 3 Drawing Sheets

METHOD AND APPARATUS FOR NON-PARALLEL TURBINE DOVETAIL-FACES

BACKGROUND OF THE INVENTION

This application relates generally to gas turbine engine rotor assemblies and, more particularly, to methods and apparatus for mounting a removable turbine blade to a turbine disk.

In a gas turbine engine, air is pressurized in a compressor and mixed with fuel in a combustor to generate hot combustion gases. The hot combustion gases are directed to one or more turbines, wherein energy is extracted. A gas turbine includes at least one row of circumferentially spaced rotor blades.

Gas turbine engine rotor blades include airfoils having leading and trailing edges, a pressure side, and a suction side. The pressure and suction sides connect at the airfoil leading and trailing edges, and extend radially from a rotor blade platform. Each rotor blade also includes a dovetail radially inward from the platform, which facilitates mounting the rotor blade to the rotor disk.

Each gas turbine rotor disk includes a plurality of dovetail slots to facilitate coupling the rotor blades to the rotor disk. Each dovetail slot includes disk fillets, disk pressure faces and disk relief faces. Rotor blade dovetails are received within the rotor disk dovetail slots such that the rotor blades extend radially outward from the rotor disk.

The dovetail is generally complementary to the dovetail slot and mate together form a dovetail assembly. The dovetail includes at least one pair of tangs that mount into dovetail slot disk fillets. The dovetail tangs include blade pressure faces which oppose the disk pressure faces, and blade relief faces which oppose the disk relief faces. To accommodate conflicting design factors, at least some known dovetail assemblies include a relief gap extending between opposed relief faces when opposed pressure faces are engaged.

In operation, typically the turbine is rotated by combustion gases. Occasionally, when combustion within the engine is terminated, atmospheric air passing through the engine will rotate the turbine at a significantly reduced rate. Such a condition is referred to as "windmilling". Reduced centrifugal forces are generated during windmilling, allowing blade pressure faces to disengage from disk pressure faces. The dovetail moves such that the blade relief faces engage the disk relief faces. The dovetail movement also forms a pressure face gap between blade pressure faces and disk pressure faces. The movement of the rotor blade may produce an audible noise, including noise from benign contact between a platform downstream wing and a forward portion of a stage two nozzle while windmilling. Continued operation with a pressure face gap may result in the entry of dirt or foreign material between the opposed pressure faces, which may cause misalignment of the rotor blade and brinelling of the pressure faces.

BRIEF DESCRIPTION OF THE INVENTION

In an exemplary embodiment, a dovetail assembly includes non-parallel relief faces that facilitate reducing pressure face brinelling in gas turbine engines. The dovetail assembly includes a plurality of rotor blades including dovetails. Each dovetail includes at least a pair of blade tangs that include blade relief faces. The dovetail assembly also includes a rotor disk that includes a plurality of dovetail slots sized to receive the dovetails. Each dovetail slot is defined by at least one pair of opposing disk tangs including disk relief faces. The dovetail assembly is configured such that when the dovetail is coupled to the rotor disk, the disk relief faces are non-parallel to the blade relief faces.

In another aspect of the invention, a method for fabricating a rotor disk for a gas turbine engine facilitates reducing radial movement of the rotor blade. The rotor disk includes a dovetail slot defined by at least one pair of disk tangs. The rotor blade includes a dovetail including at least one pair of blade tangs. The method includes the steps of forming a blade pressure face on at least one blade tang and forming a disk pressure face on at least one disk tang such that the disk pressure face is substantially parallel to the blade pressure face when the rotor blade is mounted in the rotor disk. The method further includes the steps of forming a blade relief face on at least one blade tang and forming a disk relief face on at least one disk tang such that the disk relief face is substantially non-parallel to the blade relief face when the rotor blade is mounted in the rotor disk and the disk pressure face engages the blade pressure face. As a result, the blade and disk relief faces form a reduced relief gap which facilitates limiting the entry of foreign material between the pressure faces during turbine windmilling and reducing noise resulting from rotor blade drop.

DETAILED DESCRIPTION OF THE INVENTION

Figure 1:
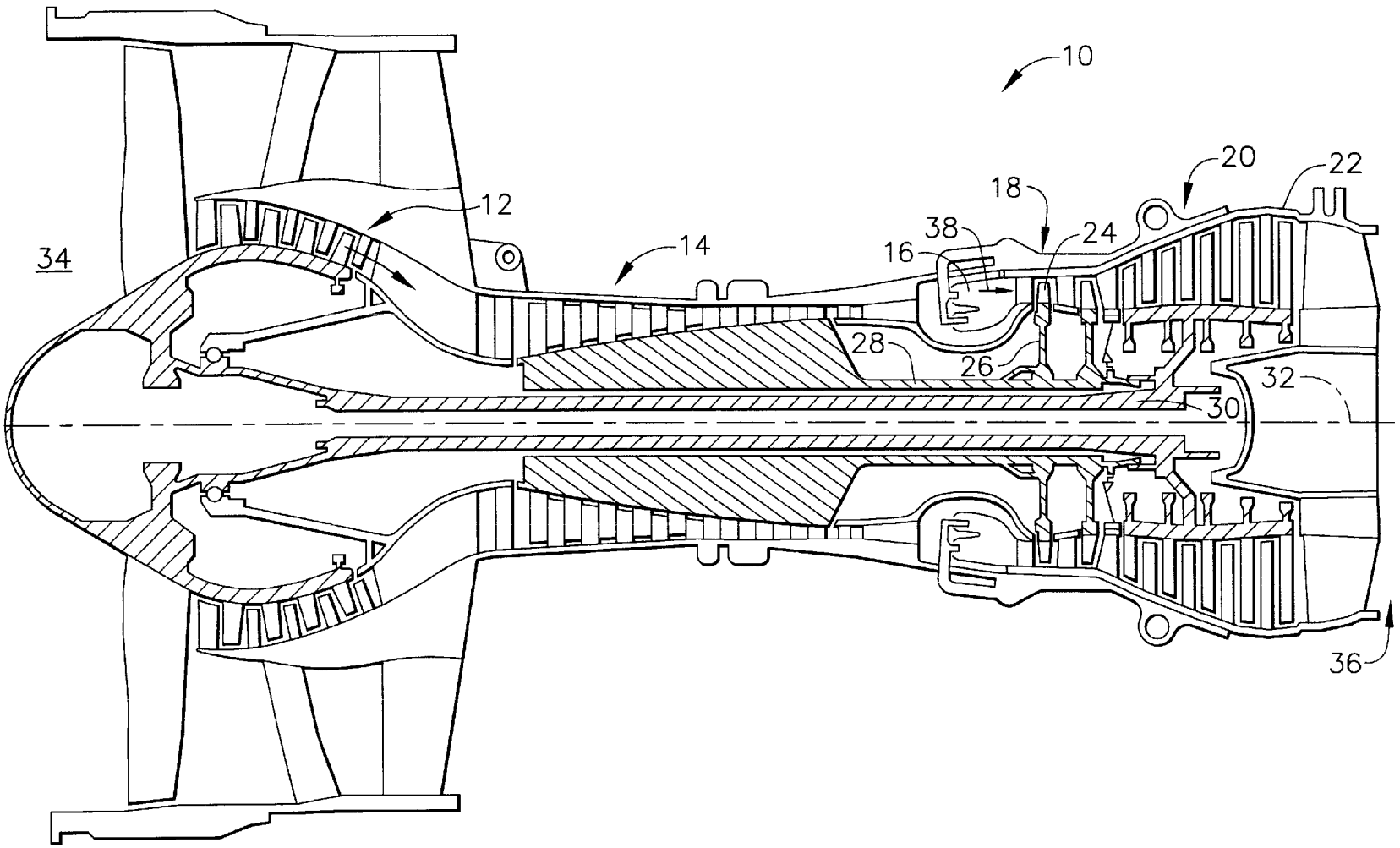
FIG. 1 is schematic illustration of a gas turbine engine.

FIG. 1 is a schematic illustration of a gas turbine engine 10 including a low-pressure compressor 12, a high-pressure compressor 14, and a combustor 16. Engine 10 also includes a high-pressure turbine 18, a low-pressure turbine 20, and a casing 22. High-pressure turbine 18 includes a plurality of rotor blades 24 and a rotor disk 26 coupled to a first shaft 28. First shaft 28 couples high-pressure compressor 14 and high-pressure turbine 18. A second shaft 30 couples low-pressure compressor 12 and low-pressure turbine 20. Engine 10 has an axis of symmetry 32 extending from an upstream side 34 of engine 10 aft to a downstream side 36 of engine 10. In one embodiment, gas turbine engine 10 is a GE90 engine commercially available from General Electric Company, Cincinnati, Ohio.

In operation, low-pressure compressor 12 supplies compressed air to high-pressure compressor 14. High-pressure compressor 14 provides highly compressed air to combustor 16. Combustion gases 38 from combustor 16 propel turbines 18 and 20. High pressure turbine 18 rotates first shaft 28 and thus high pressure compressor 14, while low pressure turbine 20 rotates second shaft 30 and low pressure compressor 12 about axis 32.

Figure 2:
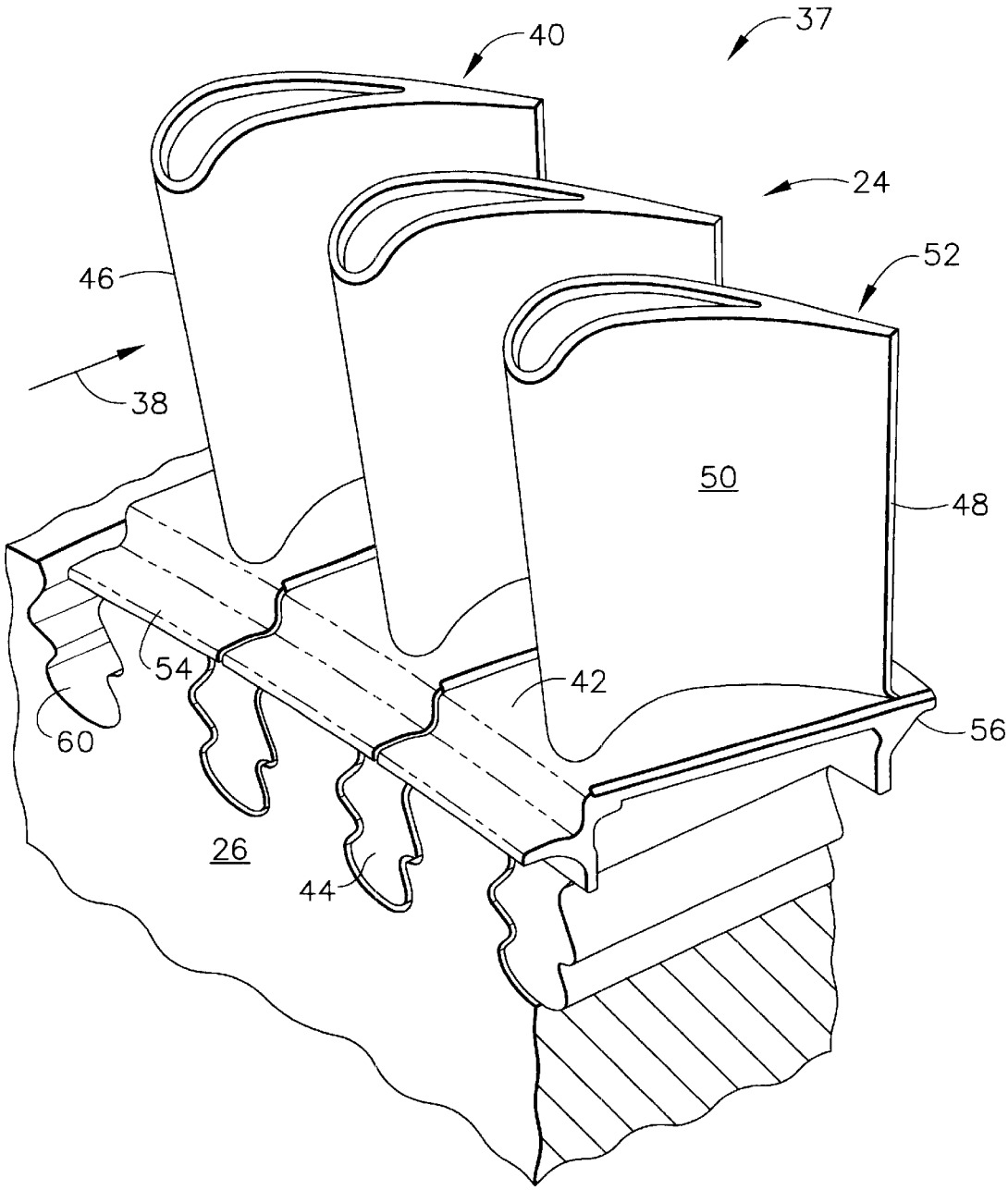
FIG. 2 is a partial perspective view of a rotor blade that may be used with the gas turbine engine shown in FIG. 1.

FIG. 2 is a partial perspective view of a disk assembly 37 including a plurality of rotor blades 24 mounted within rotor disk 26. In one embodiment, a plurality of rotor blades 24 forms a high-pressure turbine rotor blade stage (not shown) of gas turbine engine 10. Rotor blades 24 are mounted within rotor disk 26 to extend radially outward from rotor disk 26.

Each gas turbine engine rotor blade 24 includes an airfoil 40, a platform 42, and a dovetail 44. Each airfoil 40 includes a leading edge 46, a trailing edge 48, a pressure side 50, and a suction side 52. Pressure side 50 and suction side 52 are joined at leading edge 46 and at axially-spaced trailing edge 48 of airfoil 40. Airfoils 40 extend radially outward from platform 42.

Platform 42 includes an upstream wing 54 and a downstream wing 56. Dovetail 44 extends radially inward from platform 42 and facilitates securing rotor blade 24 to rotor disk 26. Platforms 42 limit and guide the downstream flow of combustion gases 38.

Figure 3:
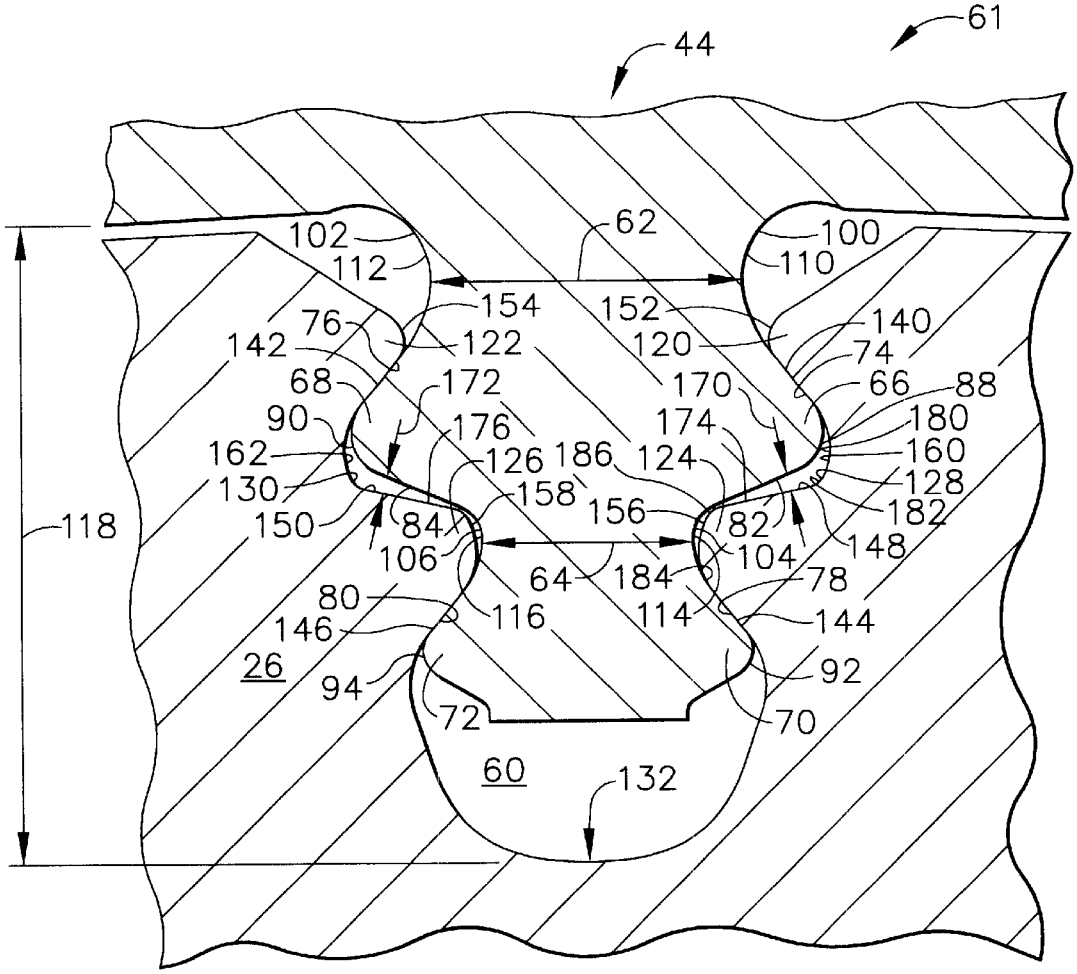
FIG. 3 is an enlarged cross-section view of a dovetail and dovetail slot that may be used with the rotor blade shown in FIG. 2.

FIG. 3 is an enlarged cross-section view of dovetail 44 and a dovetail slot 60. Dovetail 44 is mounted within dovetail slot 60, and cooperates with dovetail slot 60 to form a dovetail assembly 61. In the exemplary embodiment, dovetail 44 includes a blade upper minimum neck 62, a blade lower minimum neck 64, an upper pair of blade tangs 66 and 68, and a lower pair of blade tangs 70 and 72. In an alternative embodiment, dovetail 44 includes only one pair of blade tangs 66 and 68. Dovetail 44 also includes a pair of upper blade pressure faces 74 and 76, a pair of lower blade pressure faces 78 and 80, and a pair of blade relief faces 82 and 84. Each blade tang 66, 68, 70, and 72 includes blade tang outer radii 88, 90, 92, and 94, positioned adjacent a blade face. For example, with respect to tang 66, outer radius 88 is between blade pressure face 74 and blade relief face 82. Dovetail 44 also includes blade fillets 100, 102, 104, and 106 that include respective blade inner radii 110, 112, 114, and 116.

Each gas turbine rotor disk 26 defines a plurality of dovetail slots 60 that facilitate mounting rotor blades 24. Each dovetail slot 60 defines a radially extending slot length 118. In the exemplary embodiment, dovetail slot 60 includes a pair of upper disk tangs 120 and 122, a pair of lower disk tangs 124 and 126, a pair of upper disk fillets 128 and 130, and a slot bottom 132. Dovetail slot 60 also includes a pair of upper disk pressure faces 140 and 142, a pair of lower disk pressure faces 144 and 146, and a pair of disk relief faces 148 and 150. Each disk tang 120, 122, 124, and 126 includes disk tang outer radii 152, 154, 156, and 158, positioned adjacent a disk face. For example, disk tang outer radius 156 is between disk pressure face 144 and disk relief face 148. Dovetail slot upper disk fillets 128 and 130 further include disk fillet inner radii 160 and 162.

A plurality of relief gaps 170 and 172 extend between opposed blade relief faces 82 and 84 and disk relief faces 148 and 150 when blade pressure faces 74, 76, 78 and 80 are in contact with respective disk pressure faces 140, 142, 144, and 146. Relief gaps 170 and 172 facilitate cooling and thermal expansion in dovetail assembly 166.

Blade pressure faces 74, 76, 78, and 80 are substantially parallel to respective disk pressure faces 140, 142, 144, and 146 to facilitate engagement and to carry loading generated during turbine rotation. Respective opposed blade relief faces 82 and 84 and disk relief faces 148 and 150 are non-parallel with respect to each other. Non-parallel blade relief faces 82 and 84, and disk relief faces 148 and 150 facilitate reducing relief gaps 170 and 172 to a predetermined distance. In the exemplary embodiment, each relief gap 170 and 172 is wedge-shaped and includes an apex 174 and 176 that is adjacent disk tang outer radii 156 and 158.

Disk fillet inner radii 160 and 162 are each compound radii, and are each larger than respective blade tangs 66 and 68. Compound radii 160 and 162 facilitate distributing concentrated stresses in upper disk fillets 128 and 130, while reducing slot length 118. In the exemplary embodiment, considering only disk fillet 128, for example, compound radii 160 includes a larger radius portion 180 and a smaller radius portion 182. Larger radius portion 180 distributes the stress to rotor disk 26 while smaller radius portion 182 limits the size of disk fillet 128. Relief face 148 adjoin smaller radius portion 182 to reduce relief gap 170. Larger radius portion 180 facilitates a larger fillet and reduces stress in rotor disk 26 in the vicinity of upper disk fillets 128 relative to smaller, non-compounded radius fillets (not shown). Compound disk fillet inner radii 160, with smaller radius portion 182, facilitates reducing slot length 118, improving rotor disk 26 strength.

Disk tang outer radii 156 and 158 are also compound radii. Again, considering only disk tang 124, outer radius 156 includes a larger radius portion 184 and a smaller radius portion 186 to facilitate engagement in receiving lower blade fillet 104. Compound disk tang outer radius 156 is truncated by disk relief face 148. Compound disk tang radius 156 facilitates formation of non-parallel blade relief face 82 and reducing relief gaps 170 and 172. Compound disk tang radius 156, with smaller radius portion 186, also facilitates reducing slot length 118, thus improving rotor disk 26 strength.

In an alternate embodiment, dovetail 44 is formed with compound radii on blade tangs 66 and 68. Truncated by blade relief faces 82 and 84, blade tang outer radii 88 and 90 are each compound radii, including a larger radius than the receiving disk fillet inner radius 160 and 162. Relief faces 82 and 84 also truncate respective blade fillet inner radii 114 and 116, which are compound radii.

In another embodiment, blade tangs 66, 68, 70, and 72, blade fillets 100, 102, 104, and 106, disk tangs 120, 122, 124, and 126, and disk fillets 128 and 130 all may have compound radii.

During operation, combustion gases 38 impact rotor blades 24, imparting energy to rotate turbine 20. Centrifugal forces generated by turbine 20 rotation result in engagement and loading of blade pressure faces 74, 76, 78, and 80 with disk pressure faces 140, 142, 144, and 146. Relief gaps 170 and 172 are formed between blade relief faces 82 and 84 and disk relief faces 148 and 150.

Non-parallel blade relief faces 82 and 84 and disk relief faces 148 and 150 facilitate reducing the movement of rotor blades 24 and restrict the potential for the entry of foreign material. During operation, combustion gases 38 impact rotor blades 24, causing rotor disk 26 to rotate. Blade pressure faces 74, 76, 78, and 80 engage disk pressure faces 140, 142, 144, and 146, forming relief gaps 170 and 172 between blade relief faces 82 and 84 and disk relief faces 148 and 150. Non-parallel blade relief faces 82 and 84 and disk relief faces 148 and 150 reduce movement of rotor blade 24 when engine 10 windmills, limiting the potential for the entry of foreign material and noise resulting from rotor blade drop.

Additionally, disk tang outer radii 156 and 158 with compound radii facilitate a reduction in the slot length 118 as compared to known rotor disks and dovetails. Reduced slot length is beneficial in high-speed turbine rotor design.

The above-described rotor blade is cost-effective and highly reliable. The rotor blade includes a dovetail received in a disk dovetail slot. The non-parallel relief faces facilitate reducing rotor blade movement when the rotor is windmilling. As a result, less wearing occurs on the pressure faces, extending a useful life of the rotor blades in a cost-effective and reliable manner. Additionally, objectionable noise generated between the rotor platform and the next stage nozzle is also facilitated to be reduced.

While the invention has been described in terms of various specific embodiments, those skilled in the art will recognize that the invention can be practiced with modification within the spirit and scope of the claims.

What is claimed is:

1. A method for fabricating a rotor disk for a gas turbine engine to facilitate reducing radial movement of rotor blades, the rotor disk including a plurality of dovetail slots configured to receive the rotor blades therein, each dovetail slot defined by at least one pair of disk tangs, each rotor blade including a dovetail including at least one pair of blade tangs, said method comprising the steps of:

forming a blade pressure face on at least one rotor blade tang;

forming a disk pressure face on at least one disk tang such that the disk pressure face is substantially parallel to the blade pressure face when the rotor blade is mounted within the rotor disk dovetail slot;

forming a blade relief face on at least one blade tang;

forming a disk relief face on at least one disk relief face is substantially non-parallel to the blade relief face when the rotor blade is mounted within the rotor disk dovetail slot and the disk pressure face engages the blade pressure face; and forming a compound radius on the at least one disk tang.

2. A method in accordance with claim 1 wherein the rotor disk includes at least one pair of disk fillets, said step of forming a disk relief face further comprises the step of forming a compound radius on at least one disk fillet.

3. A method in accordance with claim 1 wherein said step of forming a disk relief face further comprises the step of forming a relief gap between respective disk relief and blade relief faces, such that each disk relief face is a predetermined distance from each blade relief face when the disk pressure face engages the blade pressure face.

4. A dovetail assembly for a gas turbine engine, said dovetail assembly comprising:

a plurality of rotor blades, each said rotor blade comprising a dovetail comprising at least a pair of blade tangs, at least one of said blade tangs comprising a pair of blade relief faces; and a disk comprising a plurality of dovetail slots sized to receive said rotor blade dovetails, each said dovetail slot defined by at least one pair of opposing disk tangs, at least one of said disk tangs comprising a pair of disk relief faces, said rotor blade relief faces being non-parallel to said disk relief faces when said dovetail is mounted within said dovetail slot, at least one of said disk tangs further comprises a compound outer radii.

5. A dovetail assembly in accordance with claim 4 wherein said pair of disk tangs are symmetrically opposed.

6. A dovetail assembly in accordance with claim 4 wherein each said pair of blade tangs are symmetrically opposed.

7. A dovetail assembly in accordance with claim 4 wherein said dovetail slot further comprises at least a pair of disk fillets, at least one of said disk fillets comprises a compound inner radii.

8. A dovetail assembly in accordance with claim 7 wherein said dovetail further comprising at least a pair of blade fillets comprising blade fillet inner radii, said disk tang compound outer radii comprising at least one radii larger than said blade fillet inner radii.

9. A dovetail assembly in accordance with claim 4 wherein at least one of said blade tangs comprises a compound outer radii.

10. A dovetail assembly in accordance with claim 9 wherein said dovetail further comprises at least a pair of blade fillets, at least one of said blade fillets comprises a compound inner radii.

11. A dovetail assembly in accordance with claim 10 wherein said dovetail slot further comprises at least a pair of disk fillets comprising disk fillet inner radii, said blade tang compound outer radii comprising at least one radii larger than said disk fillet inner radii.

12. A gas turbine engine comprising:

a plurality of rotor blades, each said rotor blade comprising an airfoil, a platform, and a dovetail, each said dovetail comprises at least a pair of blade tangs, at least one of said blade tangs comprising a pair of blade relief faces; and a rotor disk comprising a plurality of dovetail slots sized to receive said rotor blade dovetails, each said dovetail slot defined by at least one pair of opposing disk tangs, at least one of said disk tangs comprises a pair of disk relief faces, said blade relief faces being non-parallel to said disk relief faces when said dovetail is mounted in said dovetail slot, at least one of said disk tangs comprises a compound outer radii.

13. A gas turbine engine in accordance with claim 12 wherein said dovetail slot further comprises at least a pair of disk fillets, at least one of said disk fillets comprises a compound inner radii.

14. A gas turbine engine in accordance with claim 13 wherein said dovetail further comprises at least a pair of blade fillets comprising blade fillet inner radii, said disk tang compound outer radii comprises at least one radii larger than said blade fillet inner radii.

15. A gas turbine engine in accordance with claim 12 wherein at least one of said blade tangs comprises a compound outer radii.

16. A gas turbine engine in accordance with claim 15 wherein said dovetail further comprises at least a pair of blade fillets, at least one of said blade fillets comprises a compound inner radii.

17. A gas turbine engine in accordance with claim 16 wherein said dovetail slot further comprises at least a pair of disk fillets comprising disk fillet inner radii, said blade tang compound outer radii comprises at least one radii larger than said disk fillet inner radii.

* * * * *

UNITED STATES PATENT AND TRADEMARK OFFICE

CERTIFICATE OF CORRECTION

PATENT NO. : 6,592,330 B2
DATED : July 15, 2003
INVENTOR(S) : Leslie Eugene Leeke et al.

It is certified that error appears in the above-identified patent and that said Letters Patent is hereby corrected as shown below:

Column 5,
Line 23, delete "one disk relief face" insert -- one disk tang such that the disk relief face --.

Signed and Sealed this

Twenty-fifth Day of November, 2003

JAMES E. ROGAN
*Director of the United States Patent and Trademark Office*